US008925639B2

(12) United States Patent
Benson et al.

(10) Patent No.: US 8,925,639 B2
(45) Date of Patent: Jan. 6, 2015

(54) SEAL WITH BELLOWS STYLE NOSE RING AND RADIALLY DRIVABLE LOCK RINGS

(75) Inventors: Daniel Caleb Benson, Spring, TX (US); David L. Ford, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 480 days.

(21) Appl. No.: 13/312,014

(22) Filed: Dec. 6, 2011

(65) Prior Publication Data

US 2013/0140042 A1 Jun. 6, 2013

(51) Int. Cl.
*E21B 33/04* (2006.01)

(52) U.S. Cl.
USPC ..... 166/382; 166/348

(58) Field of Classification Search
CPC E21B 2003/005; E21B 33/04; E21B 33/0422
USPC ..... 166/348, 89.2, 89.3, 88.3, 75.13, 75.14, 166/382, 387, 217, 368, 208, 379
See application file for complete search history.

(56) References Cited

U.S. PATENT DOCUMENTS

| | | | | |
|---|---|---|---|---|
| 3,649,032 | A | 3/1972 | Nelson | |
| 4,615,544 | A * | 10/1986 | Baugh | 285/18 |
| 4,751,965 | A * | 6/1988 | Cassity | 166/182 |
| 5,067,734 | A | 11/1991 | Boehm, Jr. | |
| 5,307,879 | A | 5/1994 | Kent | |
| 5,456,314 | A | 10/1995 | Boehm, Jr. et al. | |
| 5,732,772 | A * | 3/1998 | Borak et al. | 166/75.14 |
| 7,762,319 | B2 | 7/2010 | Nelson | |
| 2010/0147533 | A1 | 6/2010 | Nelson | |

FOREIGN PATENT DOCUMENTS

| | | |
|---|---|---|
| GB | 2135416 A | 8/1984 |
| GB | 2489593 A | 10/2012 |

OTHER PUBLICATIONS

Search Report from corresponding GB Application No. GB1221350.0 dated Feb. 11, 2013.
U.S. Appl. No. 13/114,916, filed May 24, 2011 by Ford, et al.

* cited by examiner

*Primary Examiner* — Jennifer H Gay
*Assistant Examiner* — George Gray
(74) *Attorney, Agent, or Firm* — Bracewell & Giuliani LLP

(57) ABSTRACT

A seal assembly between a wellhead housing having a bore and a casing hanger, has an inner seal leg for sealing against a hanger and an outer seal leg for sealing against the housing. A bellows style portion is formed on a nose ring carried by the seal assembly to increase lockdown capacity. The bellows style portion has an inner surface that faces an outer profile of the hanger, and an outer surface that faces the bore of the housing. Inner and outer lock rings are disposed on the bellows style portion. When the bellows style portion is axially collapsed, it radially expands into the bore of the housing and the outer profile of the hanger, and urges the inner and outer lock rings into engagement with the outer profile of the hanger and the bore of the housing.

20 Claims, 5 Drawing Sheets

SEAL WITH BELLOWS STYLE NOSE RING AND RADIALLY DRIVABLE LOCK RINGS

BACKGROUND OF THE INVENTION

1. Field of the Invention

This invention relates in general to wellhead assemblies and in particular to a seal with a bellows style nose ring and radially drivable lock rings that improve lockdown to a casing hanger.

2. Brief Description of Related Art

Seals are used between inner and outer wellhead tubular members to contain internal well pressure. The inner wellhead member may be a casing hanger located in a wellhead housing. The casing hanger supports a string of casing extending into the well. A seal or packoff seals between the casing hanger and the wellhead housing. Alternatively, the inner wellhead member could be a tubing hanger that supports a string of tubing extending into the well for the flow of production fluid. The tubing hanger lands in an outer wellhead member, which may be a wellhead housing, a Christmas tree, or a tubing head. A seal or packoff seals between the tubing hanger and the outer wellhead member.

A variety of seals located between the inner and outer wellhead members have been employed in the prior art. Prior art seals include elastomeric and partially metal and elastomeric rings. Prior art seal rings made entirely of metal for forming metal-to-metal seals ("MS") are also employed. The seals may be set by a running tool, or they may be set in response to the weight of the string of casing or tubing. One type of prior art metal-to-metal seal has a seal body with inner and outer walls separated by a cylindrical slot, forming a "U" shape. An energizing ring is pushed into the slot in the seal to deform the inner and outer walls apart into sealing engagement with the inner and outer wellhead members. The inner and outer wellhead members may have wickers formed thereon. The energizing ring is typically a solid wedge-shaped member. The deformation of the inner and outer walls of the seal exceeds the yield strength of the material of the seal ring, making the deformation permanent.

Thermal growth between the casing or tubing and the wellhead may occur, particularly with wellheads located at the surface, rather than subsea. The well fluid flowing upward through the tubing heats the string of tubing, and to a lesser degree the surrounding casing. The temperature increase may cause the tubing hanger and/or casing hanger to move axially a slight amount relative to the outer wellhead member. During the heat up transient, the tubing hanger and/or casing hanger can also move radially due to temperature differences between components and the different rates of thermal expansion from which the component materials are constructed. If the seal has been set as a result of a wedging action where an axial displacement of energizing rings induces a radial movement of the seal against its mating surfaces, then sealing forces may be reduced if there is movement in the axial direction due to pressure or thermal effects. A reduction in axial force on the energizing ring results in a reduction in the radial inward and outward forces on the inner and outer walls of the seal ring, which may cause the seal to leak. A loss of radial loading between the seal and its mating surfaces due to thermal transients may also cause the seal to leak. One approach to preventing this type of movement is through the use of lockdown C-rings on the seal that rest in a machined pocket on the energizing ring. The C-ring engages the hanger when the seal is set, locking the seal to the hanger. Another approach has been to use the sealing element itself as a locking mechanism. In these approaches, lockdown is thus provided by the seal. Further, a lockdown style hanger may be utilized to lock the casing hanger in place. This requires an extra trip to lower the lockdown style hanger.

A need exists for a technique that addresses the seal leakage problems described above by providing additional lockdown capacity in a cost-effective way. The following technique may solve one or more of these problems.

SUMMARY OF THE INVENTION

These and other problems are generally solved or circumvented, and technical advantages are generally achieved, by preferred embodiments of the present invention that provide a casing hanger seal with a bellows style nose ring and radially drivable lock rings, and a method for using the same.

In an embodiment of the present invention, a wellhead assembly with an axis is disclosed. The assembly includes an outer wellhead member having a bore, and an inner wellhead member located in the bore. A seal ring is disposed between the inner and outer wellhead members and is in sealing engagement with the inner and outer wellhead members. A bellows style portion is disposed on a lower end of the seal ring, and the bellows style portion is axially contractible. The assembly also includes at least two lock rings disposed on the bellows style portion such that axial contraction of the bellows style portion will urge each lock ring into radial engagement with at least one of the inner wellhead member and the outer wellhead member.

In another embodiment of the present invention, a wellhead seal assembly is disclosed. The assembly includes a seal ring for sealing between inner and outer wellhead members, and a bellows style portion on a lower end of the seal ring. The bellows style portion is axially contractible and has outer surfaces and inner surfaces. The bellows style portion comprises an undulation that forms apexes and gaps between adjacent apexes. The gaps in the bellows style portion exist prior to setting and diminish in size when the bellows style portion collapses during setting. Inner and outer lock rings are disposed in the gaps such that axial contraction of the bellows style portion will urge the inner lock rings into radial engagement with the inner wellhead member and the outer lock rings into radial engagement with the outer wellhead member. A lower end of bellows style portion is adapted to land on a shoulder of the inner wellhead member and, when the seal ring is energized, the bellows style portion collapses to urge the inner and outer lock rings into radial engagement.

In still another embodiment of the present invention, a method for sealing an inner wellhead member to an outer wellhead member is disclosed. The method provides a seal assembly having a bellows style portion carried on a lower end and inner and outer lock rings located within gaps of the bellows style portion. The method lands the seal assembly between the inner and outer wellhead members, and applies an axial force to the seal assembly to axially contract the bellows style portion. The axial force urges the inner and outer lock rings disposed on the bellows style portion into engagement with the inner and outer wellhead members in response to the axial contraction of the bellows style portion. The method sets the seal assembly to seal between the inner and outer wellhead members.

The bellows style portion on the nose ring provides a mechanism of locking down the hanger in addition to those in the prior art. The radially drivable lock rings provide additional transfer of upward axial force by the casing hanger into radial force to limit casing hanger movement. Thus, lockdown capacity is advantageously increased by sharing upward forces on the hanger among the present invention and these mechanisms of the prior art. Still further, the disclosed embodiments provide a debris tolerant lockdown seal. In addition, the present invention may also advantageously save the time and money associated with having to re-trip in order to install a lockdown hanger.

BRIEF DESCRIPTION OF THE DRAWINGS

So that the manner in which the features, advantages and objects of the invention, as well as others which will become apparent, are attained, and can be understood in more detail, more particular description of the invention briefly summarized above may be had by reference to the embodiments thereof which are illustrated in the appended drawings that form a part of this specification. It is to be noted, however, that the drawings illustrate only a preferred embodiment of the invention and are therefore not to be considered limiting of its scope as the invention may admit to other equally effective embodiments.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

In the following discussion, numerous specific details are set forth to provide a thorough understanding of the present invention. However, it will be obvious to those skilled in the art that the present invention may be practiced without such specific details. Additionally, for the most part, details concerning well drilling, running operations, and the like have been omitted in as much as such details are not considered necessary to obtain a complete understanding of the present invention, and are considered to be within the skills of persons skilled in the relevant art.

Figure 1:
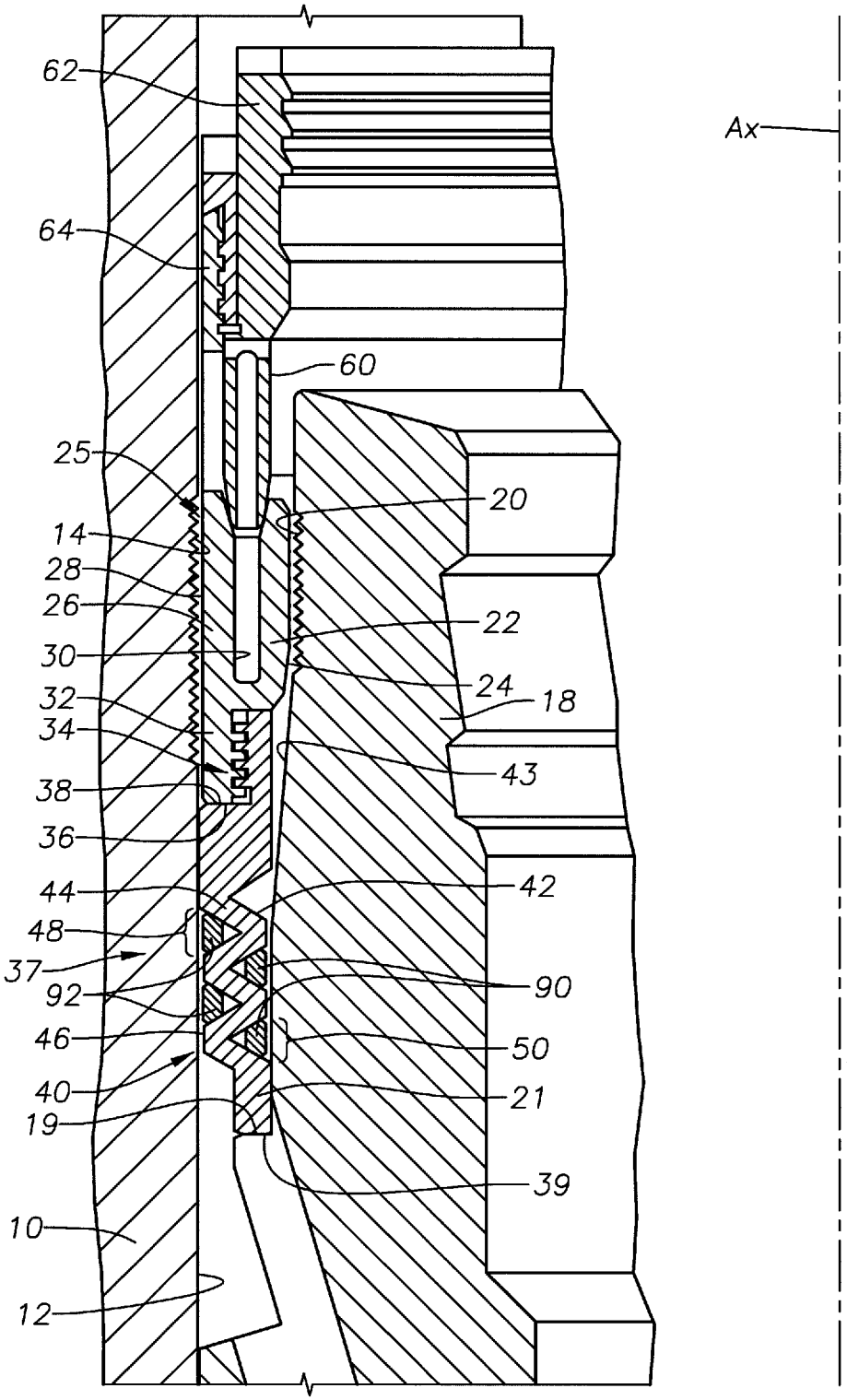
FIG. 1 is a vertical sectional view of a seal assembly with an energizing ring locked to the seal, but unset, in between inner and outer wellhead members in accordance with an embodiment of the invention.

Referring to FIG. 1, an embodiment of the invention shows a portion of a high pressure wellhead housing or outer wellhead member 10. Wellhead housing 10 includes a bore 12 with wickers 14 formed thereon. Housing 10 is typically located at an upper end of a well. A hanger 18, such as a casing hanger, having an axis $A_x$ and wickers 20 formed on an exterior portion of hanger 18 is disposed within the bore 12 of housing 10. In this embodiment, the hanger 18 has an upward facing shoulder 19 for supporting a lower portion 21 of a seal assembly. The seal assembly also includes a seal ring 25 for forming a metal to metal seal as described in more detail below. Seal ring 25 has an inner seal leg 22 with an inner wall 24 for sealing against the wickers 20 on the cylindrical wall of hanger 18. Seal ring 25 also has an outer seal leg 26 with an outer wall surface 28 for sealing against wickers 14 on bore 12 of housing 10. Wall surfaces 24, 28 may be cylindrical and smooth. Seal legs 22, 26 of seal ring 25 form a U-shaped pocket or slot 30.

Figure 3:
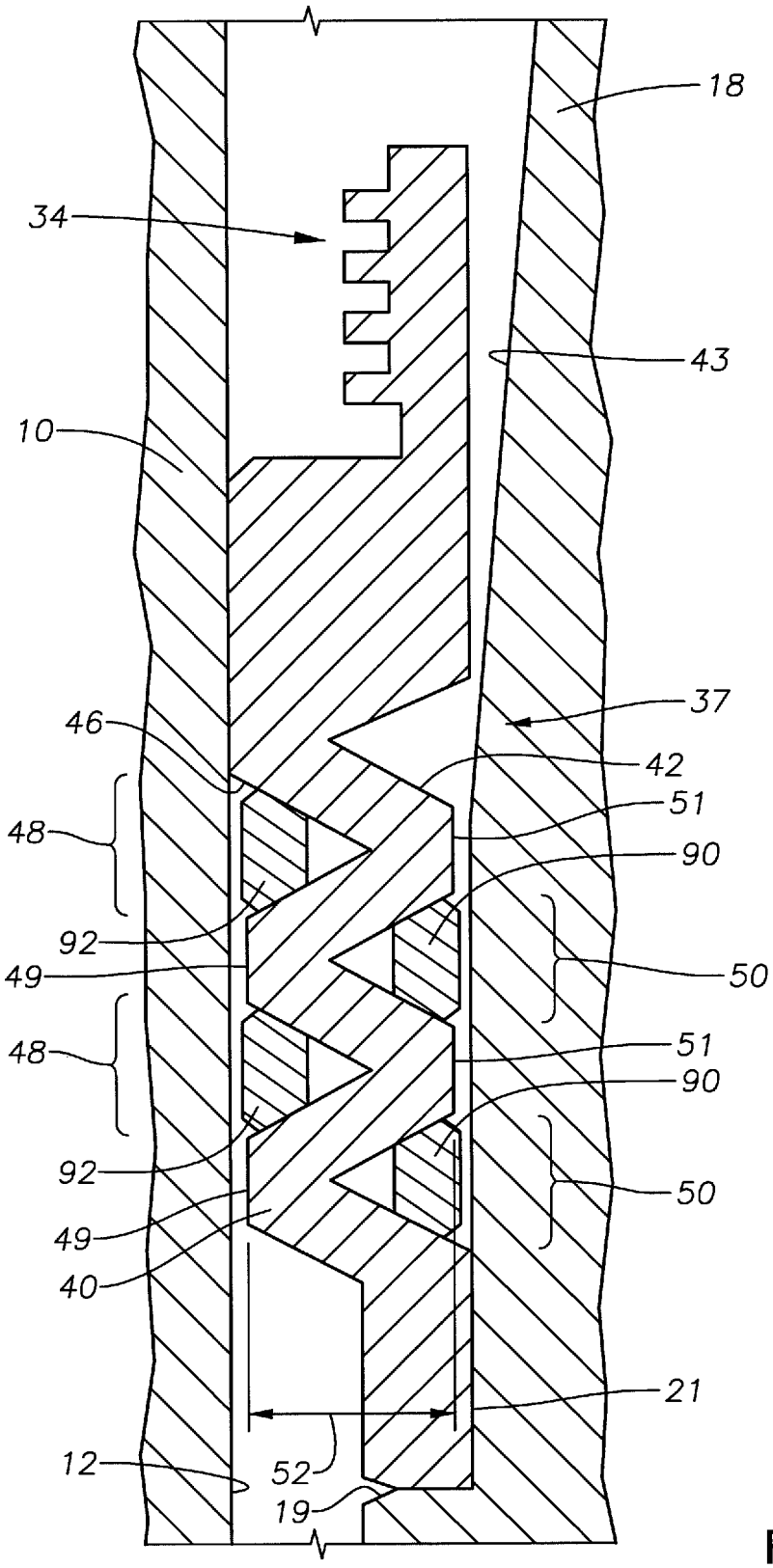
FIG. 3 is a vertical sectional view of a nose ring of the seal assembly of FIG. 1, unset, in accordance with an embodiment of the invention.

An extension 32 extends downward from outer leg 26 and may form a portion of a threaded connection 34. However, it is not necessary that the connection be threaded. Extension 32 has a downward facing shoulder 36 that rests on an upward facing shoulder 38 formed on a nose ring 37. In the illustrated embodiment, nose ring 37 includes an annular extension forming a mating portion of threaded connection 34. Threaded connection 34 connects nose ring 37 to seal ring 25. Lower portion 21 defines a downward facing annular shoulder 39 of nose ring 37 and rests on upward facing shoulder 19 of hanger 18. During setting operations, upward facing shoulder 19 provides a reaction point to set the seal assembly. In this embodiment, nose ring 37 includes a bellows style portion 40 to increase lockdown capacity of the seal assembly. The bellows style portion 40 may have a zig-zag or triangle wave shaped cross section or undulation 44 having a "V" or "U" shape as shown in FIG. 1. Bellows style portion 40 has an inner surface 42 that faces an outer profile 43 of hanger 18 axially below wickers 20. In this embodiment, outer profile 43 has a slight taper, however, outer profile 43 may also be formed without a taper. An outer surface 46 on bellows style portion 40 faces bore 12 of housing 10. As shown in FIG. 3, a width 52 of nose ring 37 at bellows style portion 40 may vary from lower portion 21 to threaded connection 34 to accommodate an increased width of the annulus between bore 12 and tapered profile 43. A thickness of bellows style portion 40 from inner surface 42 to outer surface 46 may vary as bellows style portion 40 forms undulation 44.

Figure 2:
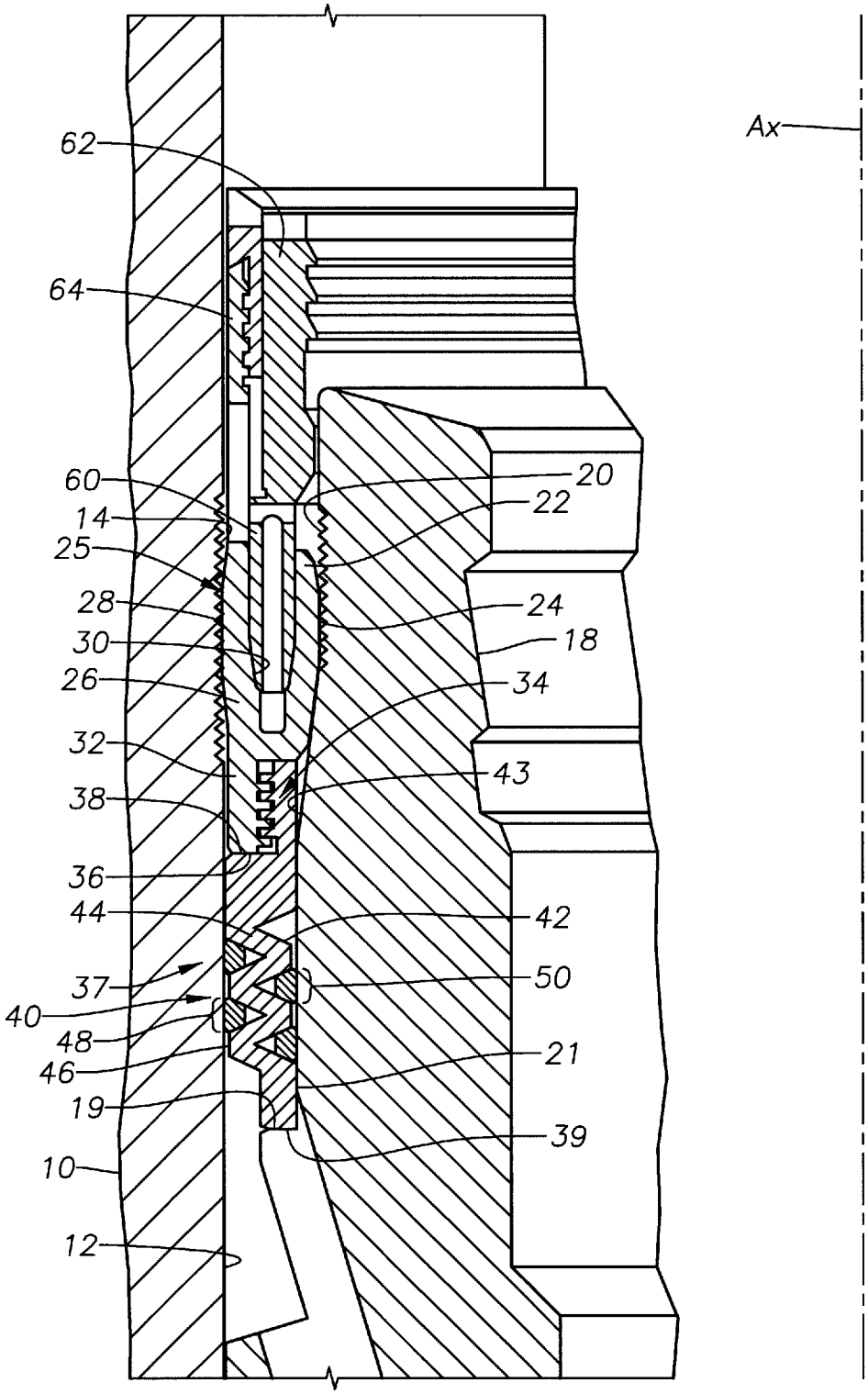
FIG. 2 is a vertical sectional view of the seal assembly of FIG. 1 between the inner and outer wellhead members in the set position, in accordance with an embodiment of the invention.
Figure 4:
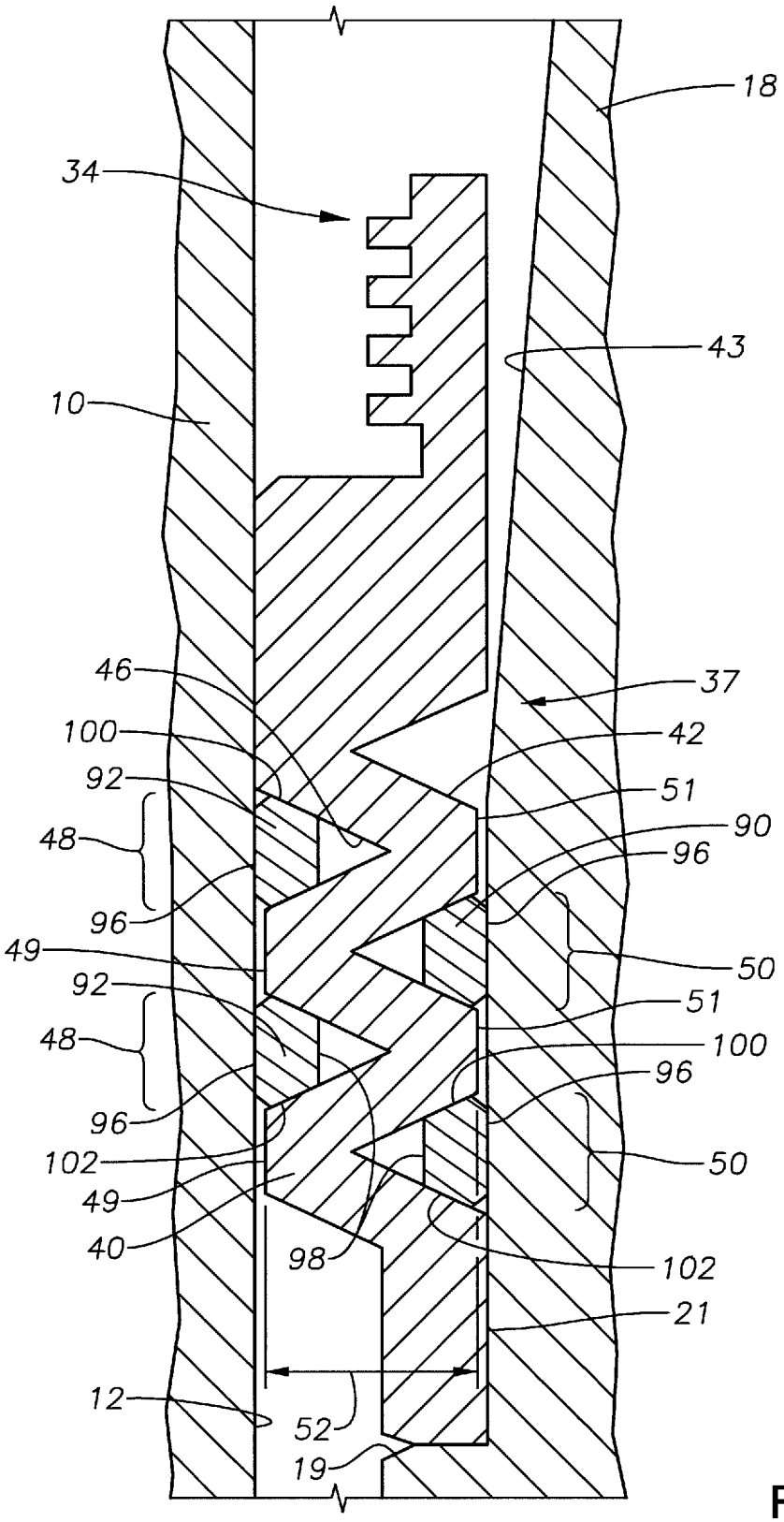
FIG. 4 is a vertical sectional view of the nose ring of the seal assembly of FIG. 1, set, in accordance with an embodiment of the invention.

Referring to FIG. 3, gaps 48 are formed between apexes 49 of the outer surface 46 of bellows style portion 40. Similarly, gaps 50 are formed between apexes 51 of the inner surface 42 of the bellows style portion 40. Gaps 48, 50 are large enough to accommodate inner and outer lock rings 90, 92, respectively. When the seal assembly is set, as shown in FIG. 2, bellows style portion 40 will collapse. Axially collapsing bellows style portion 40, as shown in FIG. 4, reduces an axial height of gaps 48, 50. Bellows style portion 40 is formed of metal. A person skilled in the art will understand that other suitable materials having a sufficient strength and pliability are contemplated and included in the disclosed embodiments.

Figure 5:
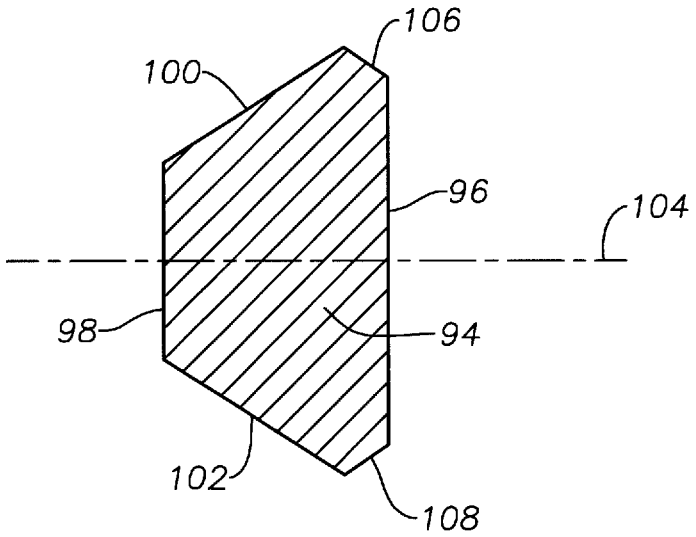
FIG. 5 is a sectional view of a lock ring in accordance with an embodiment of the present invention.
Figure 6:
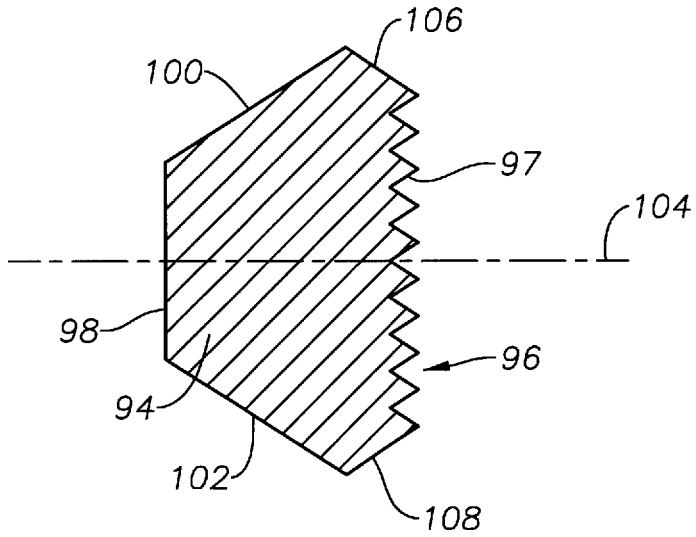
FIG. 6 is a sectional view of an alternative lock ring in accordance with an embodiment of the present invention.

Referring again to FIG. 3, inner and outer lock rings 90, 92 are positioned in corresponding inner and outer gaps 50, 48, of bellows style portion 40. As shown in FIG. 5, an exemplary lock ring 90, 92, respectively, may have a generally trapezoidal cross-sectional profile 94. Each lock ring 90, 92 will have an annular locking surface 96 proximate to bore 12 of housing 10 or outer profile 43 of hanger 18 (FIG. 3). As shown in FIG. 6, teeth/wickers 97 may be formed on locking surface 96. Referring again to FIG. 5, each lock ring 90, 92 has an annular bellows facing surface 98 opposite locking surface 96. Generally, locking surface 96 has an axial height greater than bellows facing surface 96 so that lock rings 90, 92 form annular taper surfaces 100, 102 extending between locking surface 96 and bellows facing surface 98. In the illustrated embodiment, taper surfaces 100, 102 may have similar lengths and angles so that cross-sectional profile 94 is symmetrical about a line 104 horizontally bisecting profile 94. In other exemplary embodiments, cross-sectional profile 94 is not symmetrical about line 104, such that tapper surfaces 100, 102 have different lengths. In an exemplary embodiment, taper surfaces 100, 102 are formed at an angle to Axis $A_x$ (FIG. 1) such that taper surfaces 100, 102 will be at approximately equivalent angles as the angle of the triangle wave cross section or undulation 44 when bellows style portion is in an uncompressed position as shown in FIG. 1. As described in more detail below, inner and outer surfaces 42, 46 (FIG. 3) will contact taper surfaces 100, 102 of each inner and outer lock ring 90, 92 and inner and outer lock ring 90, 92 will slide against the respective inner and outer surface 42, 46 (FIG. 4) contracting inner lock rings 90 and expanding outer lock rings 92. Each lock ring 90, 92 may be a split ring capable of radial contraction and expansion.

Residual effects of the manufacturing process may leave surfaces 42, 46 (FIG. 3) less than substantially smooth. As a result, sharp corners of an object may catch on these imperfections as the object slides across surfaces 42, 46. To accommodate this, where taper surfaces 100, 102 join locking surface 96, bevels 106, 108 may be formed as shown in FIG. 5. Bevels 106, 108 may act to allow the imperfections on inner and outer surfaces 42, 46 (FIG. 3) to slide past the transition between locking surface 96 and taper surfaces 100, 102, limiting any undesired resistance to radial movement of lock rings 90, 92 during the compression of bellows style portion 40. Locking surface 96 of inner lock rings 90 may have a profile substantially similar to outer profile 43 of hanger 18 (FIG. 3). Similarly, locking surface 96 of outer lock rings 92 may have a profile substantially similar to bore 12 of housing 10 (FIG. 3). Thus, locking surfaces 96 of inner lock rings 90 may engage outer profile 43 of hanger 18, and locking surfaces 96 of outer lock rings 92 may engage bore 12 of housing 10 when in the set position (FIGS. 2 and 4).

Inner and outer lock rings 90, 92 may be formed of any suitable material such that inner and outer lock rings 90, 92 may contract or expand as described in more detail below. In an exemplary embodiment, inner and outer lock rings 90, 92 are formed of an elastomer material allowing for deformation of inner and outer lock rings 90, 92. In another exemplary embodiment, inner and outer lock rings 90, 92 are formed of a thermoplastic material, such as Teflon or the like, also allowing for deformation of inner and outer lock rings 90, 92. In still another exemplary embodiment, inner and outer lock rings 90, 92 may be formed of a metal such as carbon steel, brass, or the like, again allowing for some deformation of inner and outer lock rings 90, 92 under sufficient loading. Lock rings 90, 92 may be split rings having a slot formed therein for radial expansion/contraction. Lock rings 90, 92 may also be continuous rings formed of a material allowing for expansion/contraction.

Referring to FIG. 1, an energizing ring 60 will be forced downward by a running tool (not shown) or the weight of a string (not shown) to force energizing ring 60 into slot 30 of seal ring 25 to set the seal assembly. An upper portion 62 of energizing ring 60 allows threaded connection to the running tool or string. An outer nut 64 keeps the assembly of energizing ring 60 together during assembly and operations. As shown in FIG. 2, energizing ring 60 deforms inner and outer seal legs 22, 26 of seal ring 25 against housing 10 and hanger 18 to set the seal assembly. In an exemplary embodiment, surfaces 24, 28 deform into wickers 20, 14, respectively to form a metal-to-metal seal.

Continuing to refer to FIG. 2, during setting operations, the seal assembly, which includes seal ring 25 and nose ring 37, is landed on upward facing shoulder 19 of hanger 18. The seal assembly is located between hanger 18 and housing 10. Energizing ring 60 is forced downward by the running tool or the weight of the string (not shown). The reaction point formed between upward facing shoulder 19 of hanger 18 and downward facing shoulder 39 of lower portion 21 of nose ring 37 allow the force applied on energizing ring 60 to axially collapse bellows style portion 40. Referring to FIG. 4, radial distance 52 between apexes 49, 51 of bellows style portion 40 when fully axially collapsed is greater than the radial distance from profile 43 of hanger 18 to bore 12 of housing 10. As bellows style portion 40 axially collapses, gaps 50 formed by inner surface 42 of bellows style portion 40 will decrease in size. As gaps 50 decrease in size, inner surface 42 will squeeze inner lock rings 90 through the mating surfaces of inner surface 42 and tapered surfaces 100, 102 of inner lock rings 90. This will cause inner lock rings 90 to contract radially into contact with outer profile 43 of hanger 18. Similarly, as bellows style portion 40 axially collapses, gaps 48 between apexes 49 of outer surface 46 of bellows style portion 40 will decrease in size. As gaps 48 decrease in size, outer surface 46 will squeeze outer lock rings 92 through the mating surfaces of outer surface 46 and tapered surfaces 100, 102 of outer lock rings 92. This will cause outer lock rings 92 to expand radially into contact with bore 12 of housing 10. As shown in FIG. 2, following set of bellows style portion 40 and inner and outer lock rings 90, 92, the axial force applied to energizing ring 60 will move energizing ring 60 into slot 30 of seal ring 25. When energizing ring 60 moves into slot 30, energizing ring 60 deforms inner and outer seal legs 22, 26 of seal ring 25 against housing 10 and hanger 18.

The engagement by lock rings 90, 92 with hanger 18 and housing 10 provides a rigid stop for the seal assembly, allowing the seal to be fully set, as shown in FIG. 2. Once set, any additional upward force on hanger 18 is transmitted into bellows style portion 40 of nose ring 37. This transmission pushes inner and outer lock rings 90, 92 into tighter contact with outer profile 43 and bore 12, thus providing greater lockdown capacities to the hanger 18 and preventing seal ring 25 from being exposed to the full upward axial forces from hanger 18 and casing (not shown). The design of nose ring 37 with bellows style portion 40 also accommodates the situation of landing high due to debris on hanger 18.

In another embodiment, bellows style portion 40 portion of nose ring 37 may be made of a material with a different coefficient of thermal expansion than hanger 18 and housing 10. This may allow bellows style portion 40 to thermally expand at a greater rate, increasing the radial force applied against outer profile 43 of hanger 18 and bore 12 of housing 10 by lock rings 90, 92. The different coefficients of thermal expansion may further add to the lockdown capacities of bellows style portion 40 and inner and outer lock rings 90, 92.

Thus, lockdown capacity is advantageously increased by sharing upward forces on the hanger among the present invention and mechanisms of the prior art. In addition, the present invention may also save the time and money associated with having to re-trip in order to install a lockdown hanger. Further, with the present invention there is no need for additional locater grooves in the housing, thus allowing for greater misalignment during operation. The bellows style portion on the nose ring also provides a mechanism of locking down the hanger, with radially moving lock rings. The radially drivable lock rings provide additional transfer of upward axial force by the casing hanger into radial force to limit casing hanger movement. Thus, lockdown capacity is advantageously increased by sharing upward forces on the hanger. Still further, the disclosed embodiments provide a debris tolerant lockdown seal.

It is understood that the present invention may take many forms and embodiments. Accordingly, several variations may be made in the foregoing without departing from the spirit or scope of the invention. Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

What is claimed is:

1. A wellhead assembly with a central axis, comprising:

an outer wellhead member having a bore;

an inner wellhead member located in the bore;

a seal ring between and in sealing engagement with the inner and outer wellhead members;

a bellows style portion on a lower end of the seal ring, the bellows style portion being axially contractible and having outer surfaces and inner surfaces; and at least two lock rings disposed on the bellows style portion such that axial contraction of the bellows style portion will urge each lock ring into radial engagement with at least one of the inner wellhead member and the outer wellhead member before the outer surfaces of the bellows style portion contact the outer wellhead member and before the inner surfaces of the bellows style portion contact the inner wellhead member.

2. The assembly of claim 1, wherein the at least two lock rings comprises an inner lock ring and an outer lock ring disposed on the bellows style portion such that the axial contraction of the bellows style portion will urge the inner lock ring into radial engagement with the inner wellhead member and the outer lock ring into radial engagement with the outer wellhead member.

3. The assembly according to claim 2, wherein:

the bellows style portion comprises undulations that meet at apexes to form gaps between the apexes, the gaps in the bellows style portion existing prior to setting; and the gaps diminish in an axial dimension when the bellows style portion collapses during setting.

4. The assembly of claim 3, wherein:

the inner and outer lock rings are positioned within the gaps of the bellows style portion; and as the gaps diminish in the axial dimension, the inner lock rings are urged radially inward to engage the inner wellhead member and outer lock rings are urged radially outward to engage the outer wellhead member.

5. The assembly of claim 4, wherein:

each inner and outer lock ring has an annular locking surface facing away from the bellows style portion;

each inner and outer lock ring has an annular bellows facing surface opposite the locking surface;

wherein the locking surface has an axial height greater than the bellows facing surface to define annular taper surfaces extending between the locking surface and the bellows facing surface; and the annular tapered surfaces are adapted to slide against the surfaces of the gaps of the bellows style portion.

6. The assembly of claim 5, further comprising beveled corners where the locking surface joins the tapered surfaces.

7. The assembly according to claim 1, further comprising:

wherein the seal ring has an inner annular member and an outer annular member circumscribing a portion of the inner annular member;

an annular energizing ring having a lower end insertable between the inner and outer annular members of the seal ring, so that when the lower end of the energizing ring is inserted between the inner and outer annular members of the seal ring, outer walls of the inner and outer annular members of the seal ring are urged radially outward into sealing engagement with the inner and outer wellhead members;

an annular extension extending downwards and located below the seal ring, the annular extension having a downward facing lower surface;

an annular nose ring connected to the annular extension, the nose ring having an upward facing shoulder in contact with the lower surface of the annular extension and having a lower surface for landing on a portion of the inner wellhead member; and wherein the inner wellhead member comprises a shoulder projecting radially outward to allow the lower surface of the annular nose ring to land, the shoulder providing a reaction point during setting operations.

8. The assembly according to claim 7, wherein the bellows style portion is formed on the nose ring and has a triangle wave shaped cross sectional profile.

9. The assembly according to claim 7, wherein the nose ring is connected to the annular extension via a threaded connection formed between the annular extension and an upward extension of the nose ring.

10. The assembly of claim 1, wherein each inner and outer lock ring has an annular locking surface facing away from the bellows style portion, and wherein a set of teeth is formed on the locking surface of the at least two lock ring radially engaged with at least one of the inner wellhead member and the outer wellhead member.

11. A wellhead seal assembly, comprising:

a seal ring for sealing between inner and outer wellhead members;

a bellows style portion on a lower end of the seal ring, the bellows style portion being axially contractible, having outer surfaces and inner surfaces;

wherein:

the bellows style portion comprises an undulation that forms apexes and gaps between adjacent apexes, the gaps in the bellows style portion existing prior to setting, the gaps diminishing when the bellows style portion collapses during setting;

inner and outer lock rings disposed in the gaps such that axial contraction of the bellows style portion will urge the inner lock rings into radial engagement with the inner wellhead member before the inner surfaces of the bellows style portion contact the inner wellhead member and the outer lock rings into radial engagement with the outer wellhead member before the outer surfaces of the bellows style portion contact the outer wellhead member; and a lower end of bellows style portion is adapted to land on a shoulder of the inner wellhead member and, when the seal ring is energized, the bellows style portion collapses to urge the inner and outer lock rings into radial engagement.

12. The assembly according to claim 11, wherein the bellows style portion has a triangle wave shaped cross sectional profile.

13. The assembly of claim 11, wherein:

each inner and outer lock ring has an annular locking surface facing away from the bellows style portion;

each inner and outer lock ring has an annular bellows facing surface opposite the locking surface;

wherein the locking surface has an axial height greater than the bellows facing surface to define annular taper surfaces extending between the locking surface and the bellows facing surface; and the annular tapered surfaces are adapted to slide against the surfaces of the gaps of the bellows style portion.

14. The assembly of claim 13, further comprising beveled corners where the locking surface joins the tapered surfaces.

15. The assembly according to claim 11, wherein a set of teeth is formed on a surface of each lock ring adapted to engage at least one of the inner wellhead member and the outer wellhead member.

16. The assembly according to claim 11, further comprising:

wherein the seal ring has an inner annular member and an outer annular member circumscribing a portion of the inner annular member;

an annular energizing ring having a lower end insertable between the inner and outer annular members of the seal ring, so that when the lower end of the energizing ring is inserted between the inner and outer annular members of the seal ring, outer walls of the inner and outer annular members of the seal ring are urged radially outward into sealing engagement with the inner and outer wellhead members;

an annular extension extending downwards and located below the seal ring, the annular extension having a downward facing lower surface;

an annular nose ring connected to the annular extension, the nose ring having an upward facing shoulder in contact with the lower surface of the annular extension and having a lower surface for landing on a portion of the inner wellhead member; and wherein the bellows style portion is formed on the nose ring.

17. A method for sealing an inner wellhead member to an outer wellhead member, comprising:

(a) providing a seal assembly having a bellows style portion carried on a lower end and inner and outer lock rings located within gaps of the bellows style portion;

(b) landing the seal assembly between the inner and outer wellhead members;

(c) applying an axial force to the seal assembly to axially contract the bellows style portion;

(d) the axial force urging the inner and outer lock rings into engagement with the inner and outer wellhead members in response to the axial contraction of the bellows style portion, before outer surfaces of the bellows style portion contact the outer wellhead member and before inner surfaces of the bellows style portion contact the inner wellhead member; and (e) setting the seal assembly to seal between the inner and outer wellhead members.

18. The method of claim 17, wherein the bellows style portion has a triangle wave shaped cross sectional profile and step (d) further comprises:

positioning the inner lock rings in the gaps between apexes of an inner diameter of the bellows style portion;

positioning the outer lock rings in the gaps between apexes of an outer diameter of the bellows style portion; and in response to axial contraction of the bellows style portion during setting of the seal assembly, decreasing a gap size and sliding tapered surfaces of the inner and outer lock rings against surfaces of the corresponding gap to urge the inner lock rings to radially contract and the outer lock rings to radially expand.

19. The method of claim 17, further comprising providing teeth on a surface of each inner and outer lock ring and driving the teeth into engagement with one of the inner and outer wellhead members.

20. The method of claim 17, wherein in the event an upward axial force is applied to the inner wellhead member, the method further comprises transferring the upward axial load to the inner and outer lock rings through the bellows style portion to urge the inner and outer lock rings into tighter engagement with the inner and outer wellhead members, respectively.

* * * * *